US005875594A

United States Patent [19]

Hellwig et al.

[11] Patent Number: 5,875,594

[45] Date of Patent: Mar. 2, 1999

[54] ACCESS DOOR FOR OFFICE PANELLING SYSTEM

[75] Inventors: John Hellwig, Toronto; Steve Verbeek, Aurora; Ian Kuznick, Bolton, all of Canada

[73] Assignee: Teknion Furniture Systems, Downview, Canada

[21] Appl. No.: 845,774

[22] Filed: Apr. 28, 1997

[51] Int. Cl.[6] ..... E04B 2/82

[52] U.S. Cl. ..... 52/220.7; 52/239

[58] Field of Search ..... 52/69, 239, 220.7, 52/36.1, 36.4, 36.5

[56] References Cited

U.S. PATENT DOCUMENTS

| | | | |
|---|---|---|---|
| 4,905,428 | 3/1990 | Sykes | 52/239 X |
| 5,086,597 | 2/1992 | Kelley et al. | 52/239 |
| 5,175,969 | 1/1993 | Knauf et al. | 52/239 |
| 5,428,928 | 7/1995 | Hellwig et al. | 52/239 |

*Primary Examiner*—Christopher Todd Kent

[57] ABSTRACT

A hinged access door is secured to an office panel frame to be removable for full access to the interior of a panel frame or movable about hinge axis to also provide access to the panel frame without removing the access door.

9 Claims, 4 Drawing Sheets

ACCESS DOOR FOR OFFICE PANELLING SYSTEM

FIELD OF THE INVENTION

The present invention relates to office panelling systems and in particular, relates to an office panel having an access door which is moveable about a hinge to access electrical receptacles behind the access door and where the access door in a closed position is positively held against the frame to eliminate unwanted movement of the access door.

BACKGROUND OF THE INVENTION

An office panelling system is disclosed in our earlier U.S. Pat. No. 4,535,577 which is incorporated herein by reference. This system has individual office panels which are connected in an end to end manner or in an angled manner. Each office panel has an interior frame to which decorative or functional cover elements are secured to provide a finished surface to either side of the frame. Various horizontal channels are provided across the frame for securing of office accessories such as work surfaces, overhead bins and other accessory structures. This panelling system provides ready access to power at desk height. This is achieved by providing an access door at approximately desk height which access door can be hinged about top hinge axis exposing a compartment within the office panel frame. The face of electrical receptacles are provided in a horizontal member of the frame and electrical equipment and can be plugged into the receptacle. In addition, excess electrical cord is stored in the panel behind the access door. In this structure, the hinge access door is urged by gravity to a closed position with the access in contact with the sides of the frame.

There are other office panelling systems where the securement of a hinged access door is similar to the securement of other releasable elements applied to the frame. For example, some releasable elements are merely held by a spring clip type arrangement to the face of an office panel frame. These securement approaches can use a conventional plug and receptacle type arrangement or as shown in our earlier patent can use a hinge and spring clip type arrangement where the elements pivot about a lower surface of the element and engage spring clips at an upper surface of the element.

Originally office panel systems were designed to support a work surface at a predetermined height and the lower edge of the access door was positioned slightly above the level of the work surface. In this way, the hinging of the access door outwardly would expose the electrical plugs behind the access door. With increased computer technology variable height work surfaces were more common and the predetermined relationship of the work surface and the lower edge of the access door was not necessarily present. Workers have personal preferences with respect to work height which can be dependent on their physical size, and/or their preferences and it has also been found that changes in the work station during a day is also desirable. There are now many arrangements from relatively simple height adjustment arrangements to hydraulic height adjustment arrangements whereby the height of a work surface is easily changed.

In many cases a work surface is at the predetermined height and does have the required relationship allowing the access door to pivot outwardly missing the work surface and thus the access door works in its intended manner. However, in other circumstances the work surface is positioned to block the access door. Fortunately once a work station is set up access to the interior of the panel is less frequent.

The present invention in a preferred embodiment provides a structure which allows convenient access to the interior of the panel frames regardless of whether the work surface is at a height overlapping with the access door.

SUMMARY OF THE INVENTION

An office panelling system according to the present invention has a series of connected office panels and each office panel has a frame defining a hollow interior through which electrical wiring conduits and communication conduits extend. Each panel includes releasable elements either side of the frame which define a finished surface of the office panel frame. Some of the releasable elements are accessed doors for conveniently accessing electrical receptacles located in the frame behind the respective access door. The access door is pivotable about a hinge axis to an open position exposing the electrical receptacles and each access door in a closed position includes a positive securing arrangement to eliminate unwanted hinge movement of the access door. The securing arrangement, in a preferred embodiment, is also releasable attached to the office panel frame whereby the entire access door may be removed when it is not possible to hinge the access door to expose the interior of the frame.

According to an aspect of the invention the releasable securement of the securing arrangement to the frame is a spring clip arrangement which engages an upper edge of the securing arrangement.

According to further aspects of the invention the securing arrangement includes a first bracket attached to the access door bracket and a second bracket connected by a hinge to the first bracket. The second bracket is releasably attached to the office panel frame for convenient removal of the access door from the office panel frame.

BRIEF DESCRIPTION OF THE DRAWINGS

Preferred embodiments of the invention are shown in the drawings wherein.

DETAILED DESCRIPTION ACCORDING TO THE PREFERRED EMBODIMENTS OF THE PRESENT INVENTION

Figure 1:
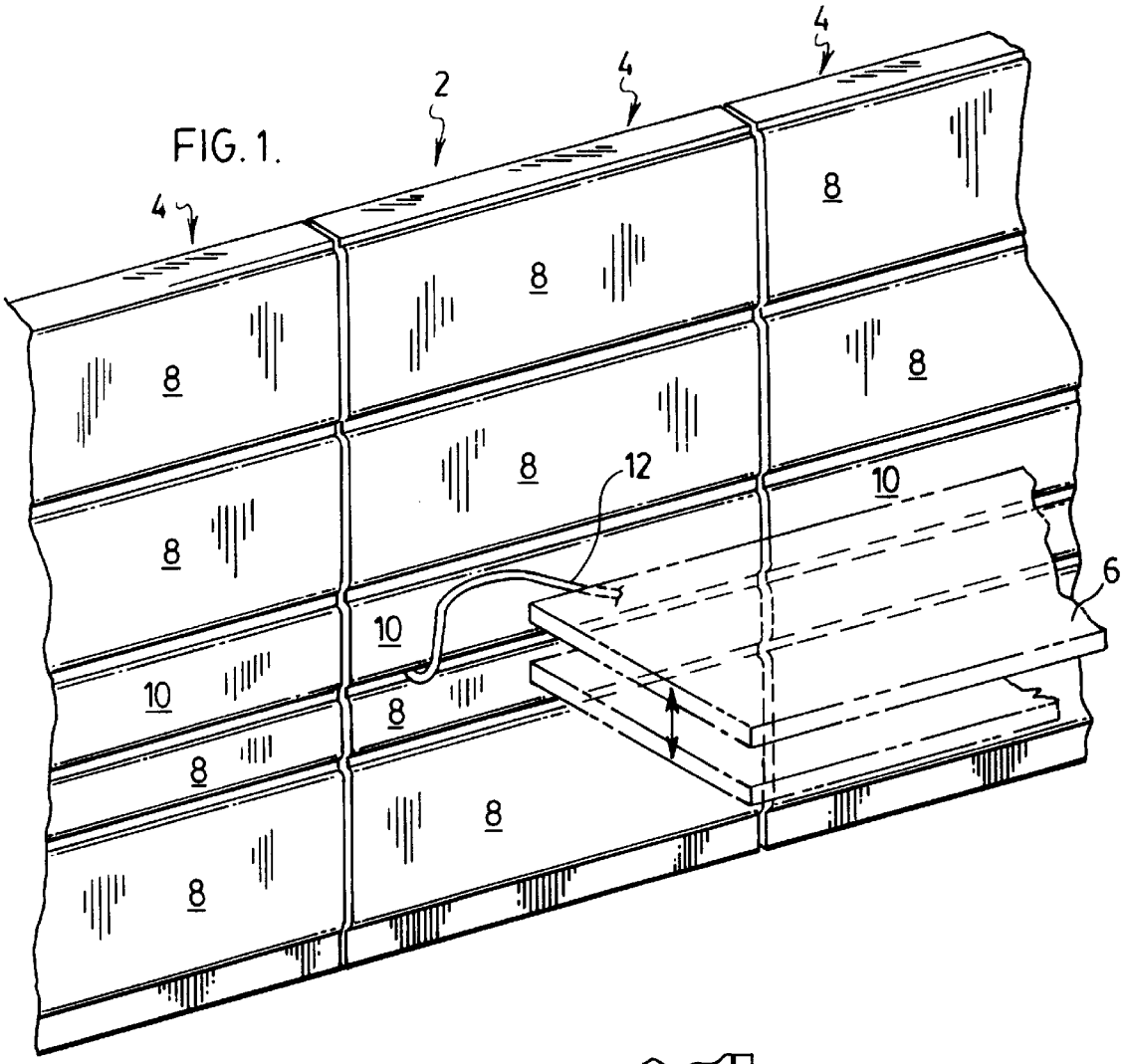
FIG. 1 is a partial perspective view of an office panelling system with a variable height work surface in front thereof.
Figure 2:
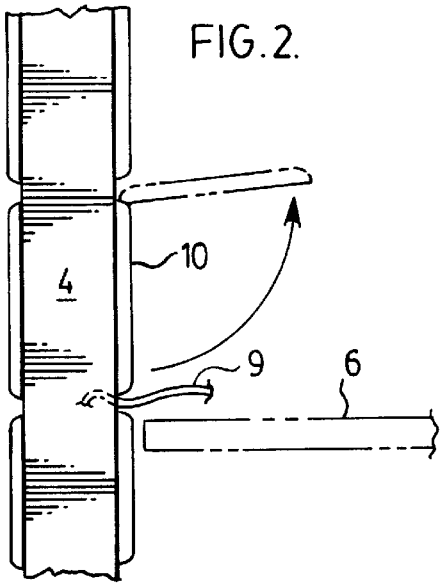
FIG. 2 is a side view showing a work surface in movement of an access door to an open position.

An office panelling system 2 shown in FIG. 1 comprises a series of connected office panels 4. In front of the office panels is a variable height work surface 6. Each office panel 4 includes releasable elements 8 which are secured to the frame of the office panel. These releasable elements define an exterior finish surface, decorative surface or functional surface to either side of the office panel. In addition, there are series of releasable access door elements 10. These access door elements can hinge outwardly as shown in FIG. 2 such that the electrical wire 12, with a suitable plug on the end thereof, can be inserted in an electrical receptacle interior to the frame of the office panel (see FIG. 6). Excess wire can also be retained within the panel frame. The hinging of the access door and the accumulation of wire and its relationship with the work surface as shown in FIG. 2 is shown in our earlier U.S. Pat. No. 4,535,577. The workstation now requires many types of service wiring, such as electrical power and communication, as but two examples. The office panels are designed to carry and allow access to the service wires.

Figure 3:
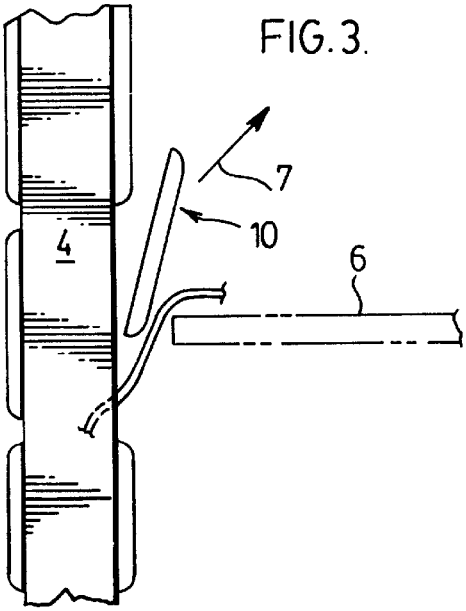
FIG. 3 is a side view of an office panel where the access door is being removed.

With variable height work surfaces, a problem arises in that the access door element 10 can overlap with a work surface as shown in FIG. 3. In this case, the work surface 6 is above the lower edge of the access door and the work surface blocks access to the interior of the panel. To overcome this problem, the access door 10 is removable as indicated in FIG. 3. Basically the top of the access door is releasably held in a spring detente relationship with the frame of the office panel and the access door is pivotable about a lower edge. In this way, the top of the door element is pulled outwardly releasing the spring detente and then the access door may be removed as indicated by arrow 9 in FIG. 3. This will be more fully explained with respect to FIGS. 4, 5 and 6.

Figure 4:
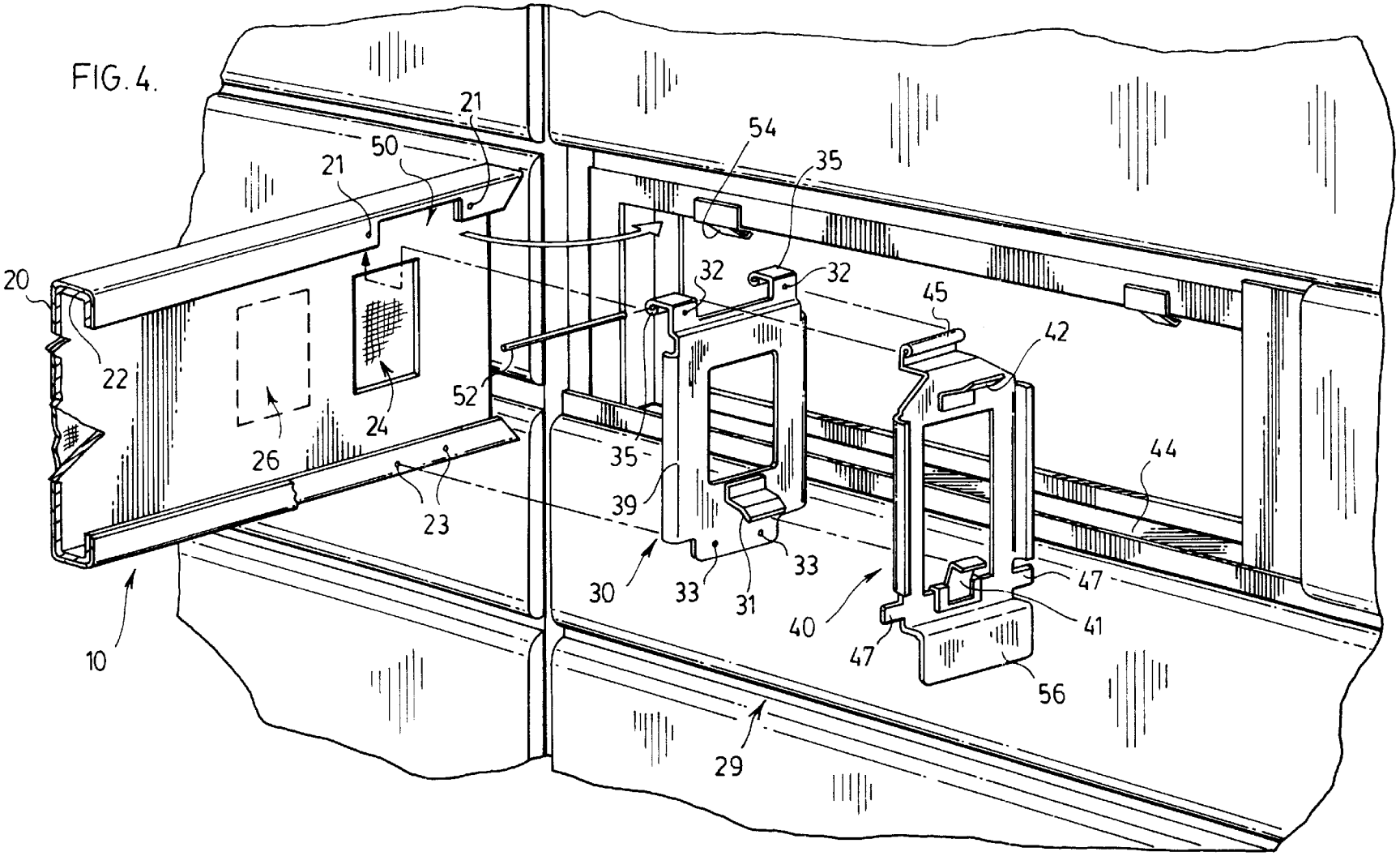
FIG. 4 is a partial perspective view showing securement of an access door to an office panel frame.

The access door element 10 shown in FIG. 4 has a channel support 22 to which a finished surface 20 is secured. The channel support 22 is preferably made of a sheet metal material, and can include knock out areas such as 26 to allow communication receptacles to be secured to the access door and exposed on the exterior of the access door. Communication wiring is low voltage and it is often desirable to provide convenient fast access thereto and this is easily accomplished by providing an outlet on the base of the access door. The channel support 22 provides excellent support and can be accurately manufactured.

The access door element 10 has a bracket arrangement 29 which comprises an access door bracket 30 and a cooperating panel frame bracket 40. The access door bracket 30 has a spring clip 31 which releasable engages the spring clip 41 provided on the panel frame bracket 40. These clips form a releasable securement of access door bracket to the panel frame bracket 40. The access door bracket 30 is hinged to the panel frame bracket at hinge pin 52. The hinge pin 52 engages two rearwardly extending flange members 35 and is received in the bearing port 45 provided on panel frame bracket 40. With this arrangement the access door bracket 30 is free to rotate about the hinge pin 52. The access door bracket 30 is positively secured to the panel support 22 at the points indicated as 32 and 33 in the access door bracket and the securement points 21 and 23 on the channel support 22.

Figure 5:
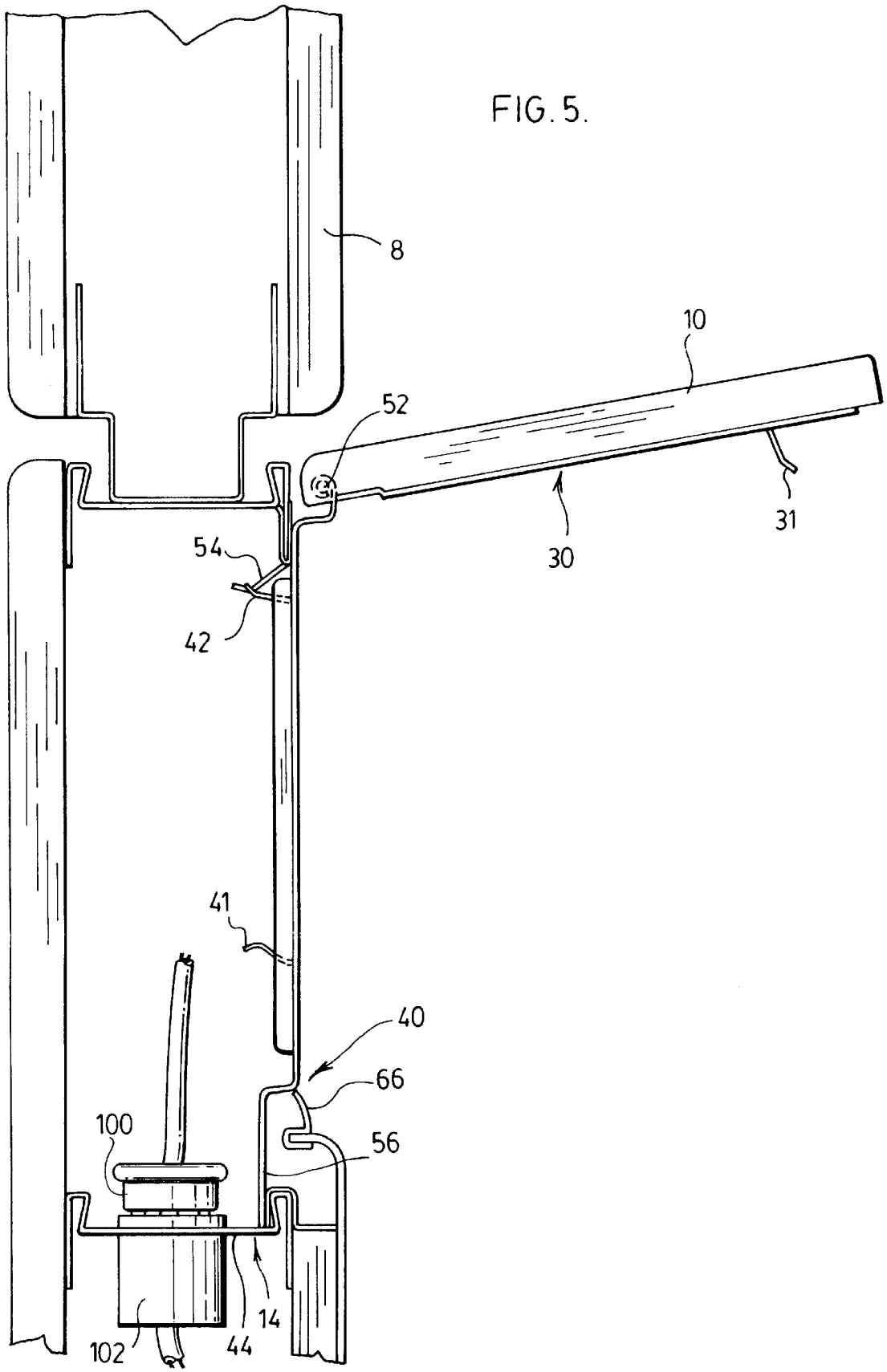
FIG. 5 is side view showing the securement of the access door to the frame of an office panel.
Figure 6:
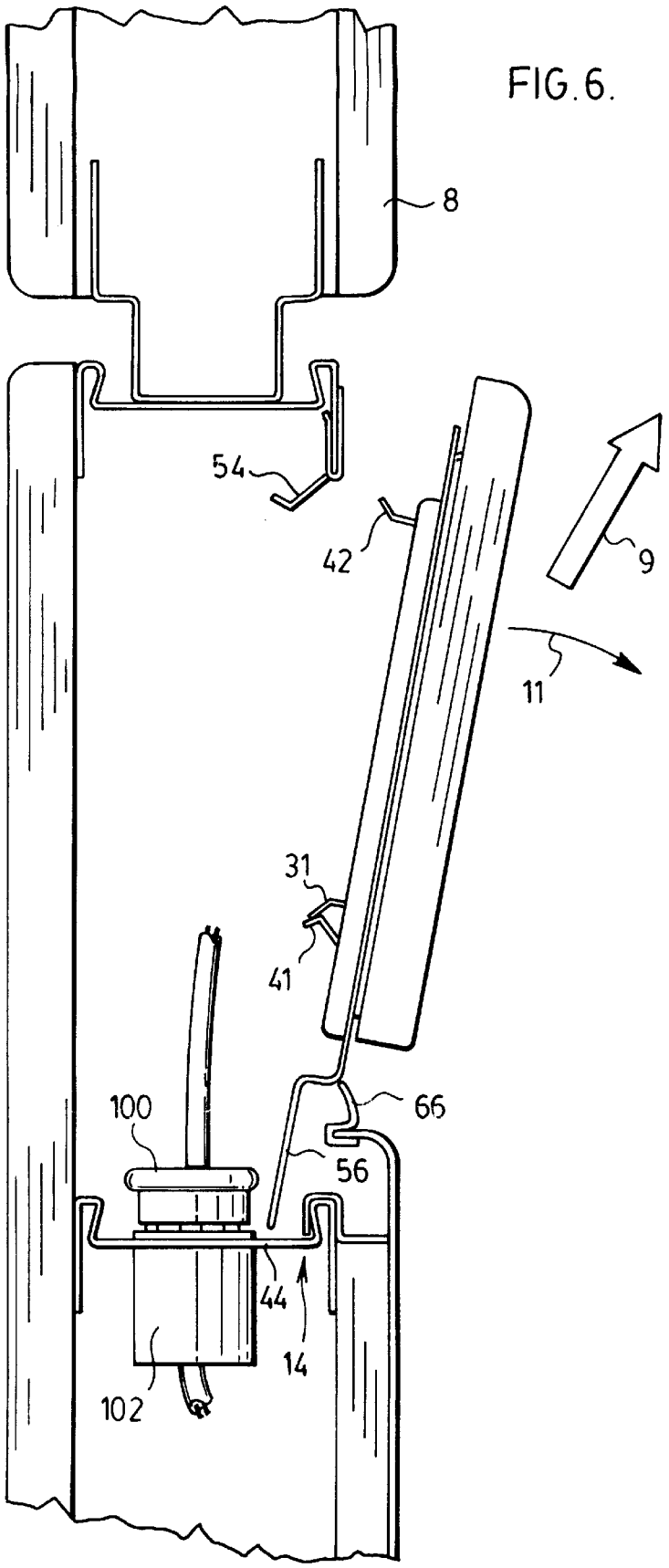
FIG. 6 is side view showing removal of an access door from an office panel frame.

A similar two piece bracket arrangement is provided adjacent the opposite end of the access door element 10 and securement of the access door to the office panel frame can be appreciated from FIGS. 5 and 6.

In FIG. 5, the access door bracket 30 and the panel frame bracket 40 are held together due to the hinge pin 52 in combination with the engagement of spring clips 31 and 41.

The panel frame bracket 40 includes a downwardly extending foot 56 which is received behind the securing channel 14 of the office panel frame. With this arrangement the access door is moved downwardly to bring the foot into the channel 14 and then rotated it inwardly to bring spring clip 42 into positive securement with spring clip 54 attached to the panel frame. The actual secured position is shown in FIG. 5. It can also be appreciated from a review of FIG. 5 that the foot 56 rests on and is supported by the horizontal surface 44 of the securing channel 14. The panel frame bracket 40 can also include outwardly extending tabs 47 for engaging a vertical portion of the panel frame to stop any inward movement above the panel frame bracket 40. Basically the tab is on the outside of the frame and the foot is on the inside thus trapping the bracket in the desired position. Tabs 47 are provided either side of the bracket 40 such that the bracket can be used at either end of the access door element. These tabs can also be relocated for engage the top edge of a support channel and thereby oppose inward movement of the panel frame bracket.

With the arrangement as shown, particularly in FIG. 5, the access door bracket and the panel frame bracket cooperate with the office panel frame to allow the desired hinge movement of the access door element 10 about the hinge pin 52. In addition, when the access door is moved to the closed position (i.e. the relative position of the access door bracket and the panel frame bracket shown in FIG. 6) the brackets are positively connected due to the engagement of spring clips 31 and 41. The panel frame bracket 40 is secured in a releasable manner by the spring clip 54 on the panel frame engaging spring clip 42 on the bracket 40.

When desired for example as would be the case if a user wanted access to an electrical plug located behind the access door 10 with a work surface as shown in FIG. 3, the access door may be removed from the panel frame as shown in FIG. 6. The access door is initially rotated in the direction of arrow 11 to release spring clip 42 from spring clip 54. Once this release has been achieved the access door as well as the access door bracket and the panel frame bracket are removed as a unit in the direction indicated by arrow 11. Once the access door has been removed the user then has full access to any part of the port exposed above the work surface. An electrical plug 100 can be removed or inserted in the receptacle indicated as 102.

In FIG. 4 a portion of the access door bracket 30 and the panel frame bracket 40 have been removed which portions are aligned 40. It is also possible to provide guide surfaces adjacent the cutout areas which engage the opposite bracket to thereby remove any sideways play when the door is in the closed condition.

The present arrangement provides accurate placement of the top edge of the access door and accurate placement of the access door within the length of the frame. The brackets cooperate with the frame to achieve this locating function and the brackets also provide the secured closed position of the access door. The brackets are accurately made and located on the channel support such that adjacent secured access doors are aligned defining a precise look while achieving the convenience of hinged access or complete removal.

The interior surface of the access door element preferably includes knock out portions 26. These can be provided in the channel support 22 at the time of manufacture and only used if desired. It can be appreciated that the decorative surface 20 can be appropriately removed in the area of a knock out when an outlet is to be installed.

A gasket member 66 has been provided adjacent the lower edge of the access door to close the gap between the bottom edge of the access and the panel frame. This gasket member is readily deformable to accommodate wires which extend under the door.

Although preferred embodiments of the invention have been described here in detail be understood by those skilled in the art that variations may be made thereto without depriving the spirit of the invention or the scope of the appended claims.

The embodiments of the invention in which an exclusive property or privilege is claimed are defined as follows:

1. An office panelling system having a series of connected office panels and each panel has a frame defining a hollow interior through which electrical wiring conduits and communication wiring and conduits extend, each panel including releasable elements either side of the frame which define a finish surface of the office panel, some of said releasable elements being access doors for conveniently accessing electrical receptacles located in said frame behind the respective access door, and wherein each access door is pivotable about a hinge axis to an open position exposing said electrical receptacles and each access door in a closed position includes a positive securing arrangement to eliminate unwanted hinge movement of said access door; and wherein each access door includes a securing bracket arrangement comprising a first bracket attached to said access door and a second bracket hingedly connected to said first bracket and releasably attached to the respective office panel frame for allowing removal of said access door from the respective office panel frame.

2. An office panelling system as claimed in claim 1 wherein said positive securement of each access door is a spring clip arrangement for releasably maintaining the access door in the closed position.

3. An office panelling system as claimed in claim 1 wherein each access door pivots about a hinge axis adjacent an upper edge of the access door.

4. An office panelling system as claimed in claim 3 wherein said first bracket and said second bracket include overlapping surfaces which are in contact and reduce sideways play of said brackets when said access door is in said closed position.

5. An office panelling system having a series of connected office panels and each panel has a frame defining a hollow interior through which service wiring extend, each panel including releasable elements either side of the frame which define a finish surface of the office panel, some of said releasable elements being access doors for conveniently accessing service receptacles located in said frame behind the respective access door, and wherein each access door includes a mounting arrangement which secures said access door to said frame, said mounting arrangement being attached to said access door and when secured in said frame, accommodating pivotting of said access door about a hinge axis to an open position exposing said electrical receptacles, and each access door is removable with said mounting arrangement from said frame; and wherein each mounting arrangement comprising a first bracket attached to said access door and a second bracket hingedly connected to said first bracket and releasably attached to the respective office panel frame for allowing removal of said access door from the respective office panel frame.

6. An office panelling system as claimed in claim 5 wherein each access door in a closed position includes a positive securing arrangement which releasably maintains said access door in the closed position.

7. An office panelling system as claimed in 5 wherein each access door pivots about a hinge axis adjacent an upper edge of the access door.

8. An office panelling system as claimed in claim 7 wherein said first bracket and said second bracket include overlapping surfaces which are in contact and eliminate sideways play of said brackets when said access door is in said closed position.

9. An office panelling system as claimed in claim 5 wherein said mounting arrangement has a foot portion engaging a channel of said frame and a spring detente structure at an upper edge of said mounting arrangement releasably maintaining said mounting arrangement in said frame.

* * * * *